US005147715A

United States Patent [19]

Thurman

[11] Patent Number: 5,147,715

[45] Date of Patent: Sep. 15, 1992

[54] CLOTHES DRYER AUGMENTATION DEVICE

[76] Inventor: Robert B. Thurman, 1565 Highway 81 East No. 166, New Braunfels, Tex. 78130

[21] Appl. No.: 623,222

[22] Filed: Dec. 4, 1990

[51] Int. Cl.[5] ..... B44D 1/46

[52] U.S. Cl. ..... 428/286; 428/284; 428/913; 34/12; 34/60; 34/72; 34/133 R

[58] Field of Search ..... 428/294, 286, 226, 232, 428/913; 34/12, 60, 72, 133

[56] References Cited

U.S. PATENT DOCUMENTS

| | | | |
|---|---|---|---|
| 3,706,140 | 12/1972 | Brillaud et al. | 34/12 |
| 3,870,145 | 3/1975 | Mizuno | 34/60 |
| 3,947,971 | 4/1976 | Bauer | 34/60 |
| 4,004,685 | 1/1977 | Mizuno et al. | 206/0.5 |
| 4,014,105 | 3/1977 | Furgal et al. | 34/12 |
| 4,108,600 | 8/1978 | Wong | 34/60 |
| 4,167,594 | 9/1979 | Schwadtke | 34/60 |
| 4,183,981 | 1/1980 | Kunzel | 428/396 |
| 4,423,105 | 12/1983 | Dillarstone | 428/286 |
| 4,560,609 | 12/1985 | Fukushima et al. | 428/220 |
| 4,567,675 | 2/1986 | Rennie | 34/60 |

*Primary Examiner*—George F. Lesmes
*Assistant Examiner*—Beverly A. Pawlikowski
*Attorney, Agent, or Firm*—Gunn, Lee & Miller

[57] ABSTRACT

Applicant's invention relates to a rectangular shaped pad composed of a heat retentive, hydrophobic textile material encapsulating a heat retentive vinyl-like material together performing a desiccating function by wicking water away from wet drying clothes onto the adsorptive surface of the textile material and facilitating the drying mechanism of a clothes dryer by raising the ambient temperature in the dryer drum which expedites water vaporization for removal from the dryer drum by the exhaust vent. The rectangular shape and stabilizing units further coordinate to maintain the structural integrity of the entire drier pad unit by preventing the pad from collapsing-in upon itself which maximizes the surface area of the pad which communicates with the drying clothes, thus decreasing the standard drying time required for removing water vapor from the dryer drum and thereby conserving valuable energy.

8 Claims, 2 Drawing Sheets

CLOTHES DRYER AUGMENTATION DEVICE

BACKGROUND OF THE INVENTION

1. Field of The Invention

Applicant's invention relates generally to a clothes drying augmentation device designed to accelerate the drying process in a conventional clothes dryer.

2. Description of Related Art

With the increased awareness of environmental issues and of energy conservation, a device which expedites the drying process in a clothes dryer is desireable and quite beneficial. Any device, particularly one which itself uses no energy, which decreases the time required to dry a given load of clothes also decreases the amount of energy necessarily expended on such drying and is beneficial to the long range goal of conservation of energy. In addition, such a device would have notable convenience considerations because of the time savings implications for the user.

Presently, the drying of clothes in a clothes dryer is an inefficient and energy intensive process. The operative process of a clothes dryer simply involves augmenting the evaporation of water from damp garments or other fabric items. In the conventional clothes dryer, this augmentation is achieved through the passage of large volumes of heated air through the clothes dryer drum. As the turbulent, heated air passes over exposed surfaces of damp garments, water on garments is gradually vaporized. In addition, contact between damp fabric and the heated surfaces within the dryer drum raises the surface temperature of damp fabric and thereby further facilitates vaporization of water from fabric surfaces. Vaporized moisture from the garments is carried from the dryer drum as the heated air is exhausted. Eventually, the garments are sufficiently dry to wear or place away.

Substantial quantities of electricity or natural gas are consumed in heating the dryer drum surfaces and the air which circulates through the drum. Because at any given time a small portion of the collective surface area of garments within a clothes dryer are exposed to the heated air or the heated surfaces within the typical dryer drum, the drying process is far from efficient. That is, the air exhausted from the clothes dryer has contacted only a small portion of the damp garments' collective surface area and is not saturated with moisture to the extent otherwise possible. As a consequence, minimum drying cycle time sufficient to adequately dry the exposed surfaces of garments in the clothes dryer is insufficient to dry the concealed surfaces which are an unavoidable by-product of the relatively compact dryer drums of typical domestic clothes dryers. Accordingly, some portion of the damp garments in a conventional clothes dryer must be "over-dried" in order to adequately dry the remainder. To the extent that this situation can be averted, energy savings can be achieved and time consumed in attending to laundry can be reduced.

One possible avenue for addressing the above-referenced problems might involve very large clothes dryers. Such dryers would permit garments a "looser" arrangement and thereby a greater exposure of damp fabric surface area to heated air and drum surfaces within the dryer. This, in turn, would increase the speed and efficiency of the clothes drying process. Alternatively, clothes dryer users may achieve substantially the same result by placing very small loads in a conventionally sized home clothes dryer and thereby achieve the same garment surface area to drum volume ratio with the attendant advantages.

Extremely large dryers are not practical in most domestic environments because of space limitations and expense. Also, drying numerous small loads for short periods of time is not within the tolerance levels of most consumers nor necessarily advantageous, from an overall economic or environmental standpoint.

An alternative approach, and that to which Applicant's invention is addressed, involves increasing the collective heated surface area within a given clothes dryer drum. With the conventional domestic clothes dryer, there are only three heated surfaces with which garments are in contact in the dryer drum: the front (door) surface, the rear surface, and the annular drum surface. There is typically a wide ratio between the collective surface area of the drum's heated surfaces and that of the average load of garments or fabric items placed in the clothes dryer. As that ratio is narrowed, the over-all evaporative process within the clothes dryer is accelerated. The drying augmentation device of Applicant's invention provides additional heated surface area within a given clothes dryer drum.

SUMMARY OF THE INVENTION

It is an object of the present invention to provide a novel drying device which expedites the drying process in a clothes dryer and thereby reduces the time and energy consumption necessary for drying clothes.

It is another object of the present invention to provide a device for use in a clothes dryer which device accelerates the drying of damp fabric items without the need for additional energy expenditure.

It is another object of the present invention to provide a drying device constructed of heat retentive textile material designed to absorb, retain and re-emit heat provided to it by the dryer's heating element(s), thus providing a heated surface in addition to that of the interior of the drying drum and thereby expediting the evaporative action of damp fabric items in a clothes dryer.

It is another object of the present invention to provide a clothes dryer augmentation device which may be used with little effort by anyone capable of using a clothes dryer.

In satisfaction of these and related objectives, Applicant's present invention provides a clothes dryer augmentation device for use in a clothes dryer drum. The device of Applicant's invention permits its user to reduce the drying time otherwise required for drying a given quantity of garments without the device.

The device is constructed of material which is generally more heat retentive than fabric items dried in clothes dryers and is water repellent. The preferred embodiment of Applicant's invention is a rectangular, sheet-like assemblage. The device includes heat sink strips made from vinyl (or similar material) which strips are encapsulated in compartments fashioned from water repellent fabric.

During use, the device moves about tumbling clothes blotting moisture therefrom. The device, which, after a time, becomes hotter than the damp items with which it comes into contact, serves as a heated surface which, somewhat like a heated iron, facilitates more rapid vaporization of water from damp garments. The water repellency of the constituent elements of the device prevents the device from becoming water saturated during use and thereby reducing or eliminating its capacity for receiving and dissipating moisture from damp garments. Because this heated surface is one in addition to those of the interior dryer drum and door surfaces, its effect is to hasten the overall clothes drying process for any given load of laundry.

While the vinyl inserts necessarily serve as heat reemitters for the proper operation of Applicant's invention, they additionally serve to lend some rigidity to the device and thereby to stabilize it. There would otherwise be a tendency for the pad to fold-in upon itself as the device and the garments tumble together. In a highly convoluted configuration, the device would have a significant amount of surface area unavailable for communicating with the damp garments and thereby partially defeat its intended function. To increase the effectiveness of the device, vinyl inserts are chosen which are stiffer than the surrounding textile material and which will accordingly tend to maintain to pad in an minimally convoluted configuration.

The increased water vaporization exchange between the clothes and the dryer augmentation device will lessen the time otherwise necessary for drying a given quantity of wet fabric items. By lessening the time necessary for drying, the amount of electricity or gas use in that process with be reduced. Over any substantial period of time, a significant amount of energy will be saved and energy bills will be reduced through the use of the drying device of Applicant's invention.

Through exhaustive experimentation, it has been determined that the device of Applicant's invention effects a reduction in drying time of approximately twenty (20%) percent of the time required to dry any given load of damp fabric items absent the device. This time savings will, over any significant period of time, account for sizeable energy and cost savings to the user.

DETAILED DESCRIPTION OF THE PREFERRED EMBODIMENT

Figure 1:
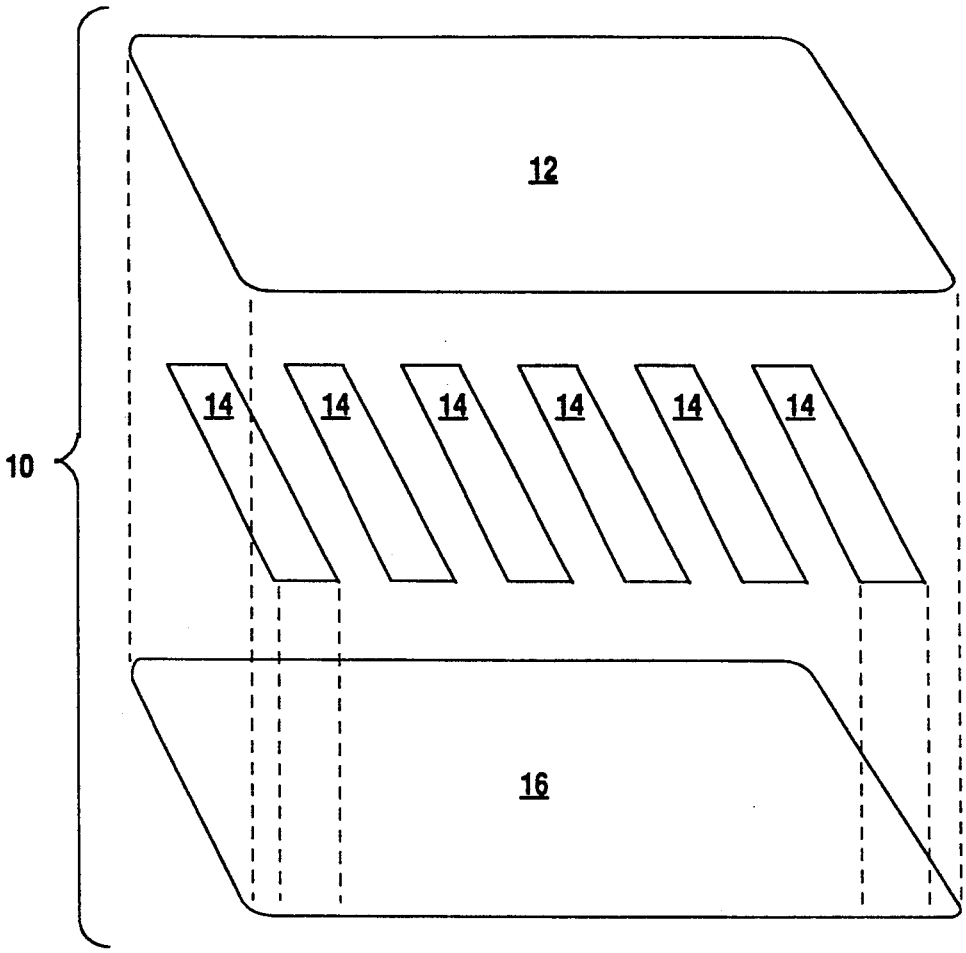
FIG. 1 is an exploded perspective view of the drying device in accordance with the preferred embodiment of the invention.

Referring to FIG. 1, an exploded perspective view of a preferred embodiment of the fully intact drying device 10. The fully intact device 10 includes a top layer 12 and bottom layer 16, each fashioned, in the preferred embodiment, from a tightly woven cotton/synthetic blend such as sixty-five (65%) percent KORDELL combined with thirty-five (35%) percent cotton. The fabric is treated so as to be water repellent. This may be achieved by applying SCOTCH GUARD (manufactured by Minnesota Mining & Manufacturing Company of Minneapolis, Minn.), or some substantially equivalent product.

Vinyl inserts 14 are aligned parallel and equidistance to each other, and are secured between top layer 12 and bottom layer 16 in the assembled device 10. The vinyl inserts 14 are oriented perpendicular to the long side of the device 10 in the preferred embodiment.

Because of cost considerations and of material availability, the preferred embodiment includes vinyl inserts 14 which are fashioned from fabric-backed vinyl such as is commonly used to re-upholster vinyl furniture and which is readily available at fabric shops. Non-fabric backed vinyl is certainly acceptable for the vinyl inserts 14 (in fact preferable) but due to material costs are not, at this time, represented as being the preferred embodiment.

Figure 2:
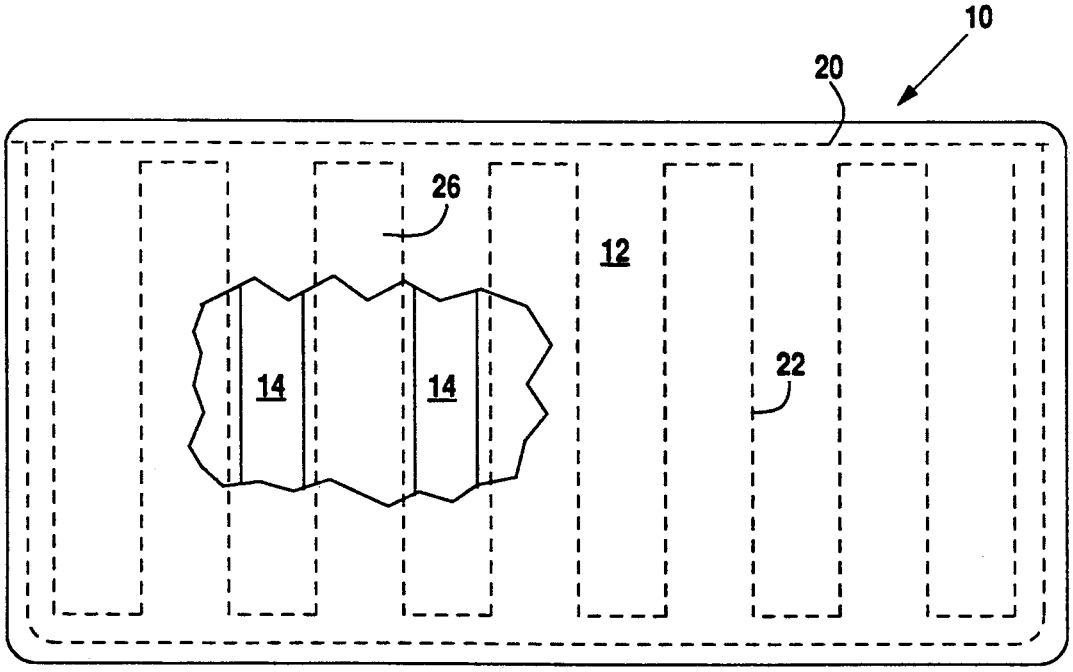
FIG. 2 is a top plan view of the intact drying device in accordance with the preferred embodiment of the invention with a partial cutaway view of some of the heat sink strips thereof.

Referring now to FIG. 2, top layer 12 and bottom layer 16 are positioned and affixed as they would appear in the intact device 18. Top layer 12 and bottom layer 16 are affixed by peripheral stitching 20 which circumvents the vinyl inserts 14. Internal stitching 22 serves, in combination with peripheral stitching 20 to encapsulate the vinyl inserts 14 between top layer 12 and bottom layer 16. Internal stitching 22 should be positioned such that vinyl inserts 14 are secured equidistant apart, separated by interstitia 26. The interstitia 26 serve to lend sufficient flexibility to the device 10 such that it is easy to insert into a clothes dryer and can effectively communicate and co-mingle with clothing during its use.

Figure 3:
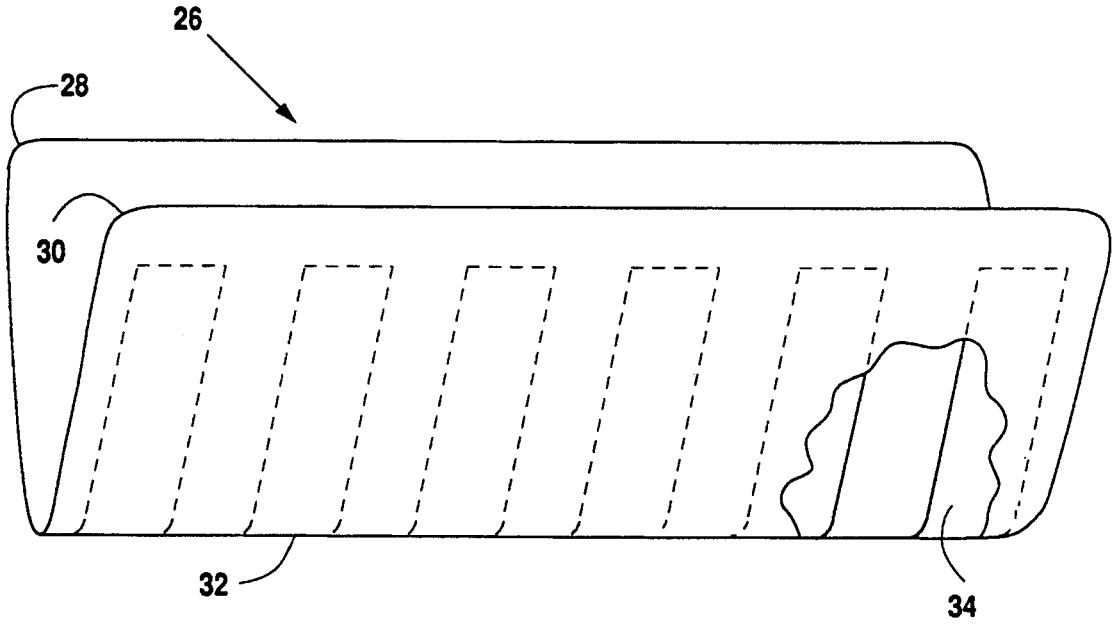
FIG. 3 is a perspective view of an alternative embodiment of Applicant's invention with a partial cutaway view of some of the heat sink strips thereof.

Referring to FIG. 3, an alternative embodiment 26 of the device of Applicant's invention exhibits a top layer 28 and bottom layer 30 which, in this alternative embodiment, are portions of a single sheet of textile material. Top layer 28 and bottom layer 30 are positioned, matched, and affixed by a longitudinal pleat 32. The completed single sheet embodiment 26 resembles the intact pad 18 in FIG. 2 with the vinyl inserts 34 being secured in the same general fashion as with the embodiment of FIG. 2.

Through extensive experimentation, Applicant has determined that the optimum size for the device 10 may be derived from the surface area of the dryer drum. Ideally, the surface area (in inches) for each side of the device 10 is approximately equal to one-half of one hundred-twenty 120% percent of the surface area of the interior, annular dryer drum surface divided by two. Also, the short side of the rectangular device 10 should, in the preferred embodiment, be approximately twenty (20%) percent longer (four to six inches in most cases) than the depth of the dryer drum (as measured along the rotational axis thereof).

Having determined the optimum surfaces area of the device 10 as above described and measured the depth of the drum of the clothes dryer with which the device 10 is to be used, the length of the long side of the device 10 can be readily derived.

Notwithstanding the foregoing, so long as the short side of the device 10 measures between six inches in excess of the drum depth and the equivalent of such drum depth, acceptable performance can be achieved.

Although the invention has been described with reference to specific embodiments, this description is not meant to be construed in a limited sense. Various modifications of the disclosed embodiments, as well as alternative embodiments of the inventions will become apparent to persons skilled in the art upon the reference to the description of the invention. It is, therefore, contemplated that the appended claims will cover such modifications that fall within the scope of the invention.

I claim:

1. A device for acceleration of the drying process in a clothes dryer without connection to or incorporation of means for independently generating heat comprising:

a water repellent fabric member; and a plurality of heat retentive members (14) encapsulated within said fabric member, said heat retentive members comprising a semi-rigid plastic material, said fabric member and heat retentive members being constructed of materials which are more heat retentive than fabric items dried in the clothes dryer.

2. The device of claim 1 wherein said heat retentive members are elongate members formed from plastic sheeting.

3. The invention of claim 2 wherein said fabric member is a rectangular structure comprising first and second fabric layers with said heat retentive members being encapsulated therebetween, said heat retentive members being oriented with their respective long axes parallel with each other and perpendicular to long side of said fabric member.

4. The invention of claim 3 wherein the surface area of each of said fabric member's two broad faces is calculable according to the following formula:

$$F=D/2*1.2$$

wherein F=surface area of each face of said fabric member and D =surface area of the annular drum surface of a clothes dryer in which said device is to be used, and wherein the length of said short side of said fabric member is equal, as a minimum, to the depth of the rotation axis of said dryer drum and, as a maximum, to said depth of said rotation axis of said dryer drum plus twenty (20%) percent of said depth.

5. A method for accelerating the drying of damp fabric items in a clothes dryer comprising the steps of:

selecting a device for acceleration of the drying process in a clothes dryer comprising:

a water repellent fabric member; and a plurality of heat retentive members (14) encapsulated within said fabric member, said heat retentive members comprising a semi-rigid plastic material, said fabric member and heat retentive members being constructed of materials which are more heat retentive than fabric items dried in the clothes dryer.

6. The method of claim 5 wherein said heat retentive members are elongate members formed from plastic sheeting.

7. The invention of claim 6 wherein said fabric member is a rectangular structure comprising fabric layers with said first and second heat retentive members being encapsulated therebetween, said heat retentive members being oriented with their respective long axes parallel with each other and perpendicular to the long side of said fabric member.

8. The invention of claim 7 wherein the surface area of each of said fabric member's two broad faces is calculable according to the following formula:

$$F=D/2*1.2$$

wherein F=surface area of each face of said fabric member and D =surface area of the annular drum surface of a clothes dryer in which said device is to be used, and wherein the length of said short side of said fabric member is equal, as a minimum, to the depth of the rotation axis of said dryer drum and, as a maximum, to said depth of said rotation axis of said dryer drum plus twenty (20%) percent of said depth.

* * * * *